US005292141A

United States Patent [19]

Ekedal et al.

[11] Patent Number: 5,292,141

[45] Date of Patent: Mar. 8, 1994

[54] SKATEBOARD HAVING ROTATABLY MOUNTED DISK WITH OR WITHOUT ILLUMINATION

[75] Inventors: David R. Ekedal, Carlsbad, Calif.; Kenneth D. Harris, Jr., Winsted, Conn.; Michael C. Copley, San Diego, Calif.

[73] Assignee: Soaring Minds, Carlsbad, Calif.

[21] Appl. No.: 844,447

[22] Filed: Mar. 2, 1992

Related U.S. Application Data

[63] Continuation-in-part of Ser. No. 576,859, Sep. 4, 1990, Pat. No. 5,119,277.

[51] Int. Cl.[5] ..... B62K 9/00

[52] U.S. Cl. ..... 280/87.042; 362/61

[58] Field of Search ..... 280/87.042, 87.041, 280/11.19, 607, 633, 620, 809; 362/61; 384/420, 908

[56] References Cited

U.S. PATENT DOCUMENTS

| | | | |
|---|---|---|---|
| 3,075,816 | 1/1963 | Harris | 384/420 |
| 3,771,811 | 11/1973 | Bueno | 280/87.042 |
| 3,977,688 | 8/1976 | Imagawa | 280/633 |
| 4,160,554 | 7/1979 | Cooney | 280/87.042 |
| 4,202,559 | 5/1980 | Piazza | 280/87.042 |
| 4,445,699 | 5/1984 | Darasko | 280/87.041 |
| 4,854,745 | 8/1989 | Kimimura et al. | 384/420 |
| 4,991,066 | 2/1991 | McCowan | 280/87.042 |
| 5,004,256 | 4/1991 | Won | 280/87.042 |
| 5,119,277 | 6/1992 | Copley et al. | 280/87.042 |

FOREIGN PATENT DOCUMENTS

| | | | |
|---|---|---|---|
| 2440208 | 7/1980 | France | 280/87.042 |

*Primary Examiner*—David M. Mitchell

[57] ABSTRACT

A skateboard comprising a rotatable disk mounted on the top surface of the skateboard's riding platform surface for rotatably maneuvering the skateboard in different directions. The skateboard may include front and rear illumination sources mounted within respective front and rear housings secured to the underside of the riding platform.

11 Claims, 7 Drawing Sheets

SKATEBOARD HAVING ROTATABLY MOUNTED DISK WITH OR WITHOUT ILLUMINATION

RELATED APPLICATIONS

This application is a continuation-in-part of application Ser. No. 07/576,859, filed Sep. 4, 1990, now U.S. Pat. No. 5,119,277.

FIELD OF THE INVENTION

This invention relates generally to skateboards and illuminated skateboards, and is particularly related to such skateboards which include a disk mounted on the skateboard's riding platform for rotatably maneuvering the skateboard.

The present invention also provides a novel disk for use in said rotatable skateboards.

BACKGROUND OF THE INVENTION

In recent years, skateboards have gained increasing popularity not only for sports and recreational purposes but for some occupations as well. For instance, messengers and couriers are using skateboards rather than other modes of transportation, and waiters and waitresses in outdoor restaurants and similar facilities are also finding it more convenient to use skateboards to quickly move about. Frequently these skateboards are used in the evening or at night when due to poor visibility there is greater likelihood of accidents and injuries resulting from their use. In order to make the device, and hence the person riding thereon, safely visible, it has been proposed to use an illuminating device in conjunction with the skateboard. Thus, U.S. Pat. No. 4,336,573 discloses an illuminated skateboard comprising a person carrying platform under which is a pair of axles supported from the platform and rolling wheels engaged thereon. A power source is disposed on the bottom surface of the platform and is operatively connected to a light source so as to illuminate the wheels of the skateboard. The wheels are made from translucent material in order to transmit the light generated by the power source along the outer faces of the wheels.

U.S. Pat. No. 4,094,372 discloses a motorized skateboard whereby the skateboard becomes a self-propelled device. The motorized skateboard described in said patent, however, is not equipped with an illuminating means.

Also, in skateboards which have heretofore been in common use, the riding platform is usually rotated by the rider by pressing one or both feet on the upper surface of the riding platform and manipulating the platform into different degrees of rotation. This, however, requires great force and skill and is frequently laborious and tiresome to the rider.

SUMMARY OF THE INVENTION

In accordance with this invention, the skateboard comprises a riding platform, a pair of front wheels and a pair of rear wheels, all depending from and carried by the riding platform. The front wheels and the rear wheels are rotatable about the front axle and rear axle, respectively. A means, such as a rotatable disk, is provided at the upper surface of the riding platform for rotatably maneuvering the skateboard with relative ease by the rider.

When it is desired to provide the skateboard with illumination for safety or other purposes, a front housing is secured to the bottom surface of the riding platform at the front of the skateboard and a rear housing is secured to the bottom surface of the riding platform at the rear of the skateboard. Each of said housings comprises an illumination source and a power source connected to said illumination source by means of an electrically conducting element such as a wire. A switch means is mounted on the surface of the riding platform and is operable to establish contact between the illumination source and the power source in the front and rear of the skateboard.

BRIEF DESCRIPTION OF THE DRAWINGS

In the drawings, wherein like reference numerals are employed to designate like parts.

DETAILED DESCRIPTION OF THE INVENTION

Figure 1:
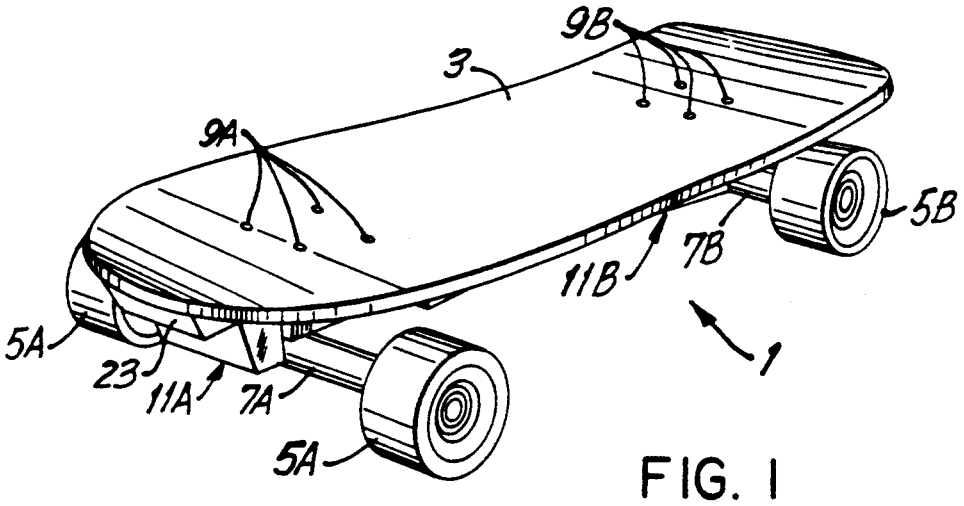
FIG. 1 is a prospective view of a typical skateboard embodying the principles of the present invention.

Referring first to FIG. 1 of the drawings, there is shown a skateboard generally designated as 1 comprising a riding platform 3 a pair of front wheels 5A, 5A and a pair of rear wheels 5B, 5B rotatably mounted about their respective axles 7A, 7B. The platform 3 is provided with front mounting screws 9A and rear mounting screw 9B for securing the platform to the front housing assembly 11A and rear housing assembly 11B as hereinafter described and shown in FIGS. 2 and 3.

Figure 2:
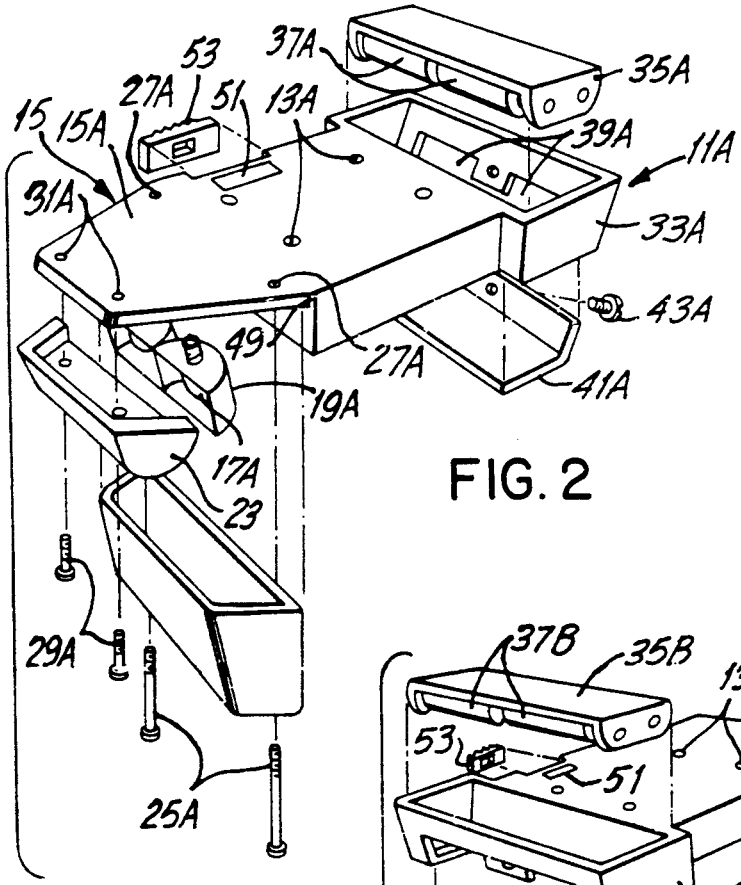
FIG. 2 is an exploded view of the front lights housing assembly at the bottom of the skateboard.
Figure 3:
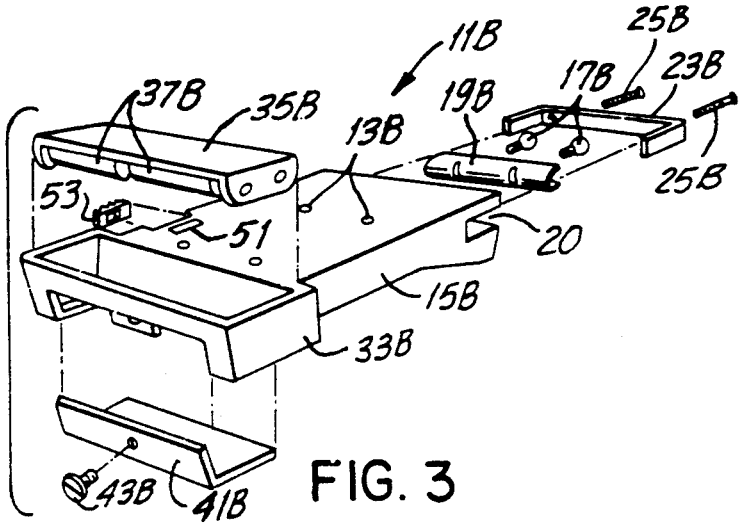
FIG. 3 is an exploded view of the rear lights housing assembly at the bottom of the skateboard.

In FIGS. 2 and 3, there are shown the front housing 11A and rear housing 11B, each provided, respectively, with front mounting holes 13A and rear mounting holes 13B. The front screws 9A and the rear screws 9B may be threaded externally, and the front mounting holes 13A and the rear mounting holes 13B may be threaded internally for threaded engagement of the mounting screws into their respective mounting holes, thereby securing the housings 11A and 11B between the platform 3 and the removable front and rear trucks 45A and 45B as are more clearly shown in FIG. 5. Alternatively, the mounting screws 9A and 9B may be inserted through their corresponding mounting holes 13A and 13B and tightly secured by means of suitable nuts and bolts and thus secure the housings 11A and 11B between the platform 3 and the front and rear removable trucks 45 and 45B (as aforementioned).

Figure 4:
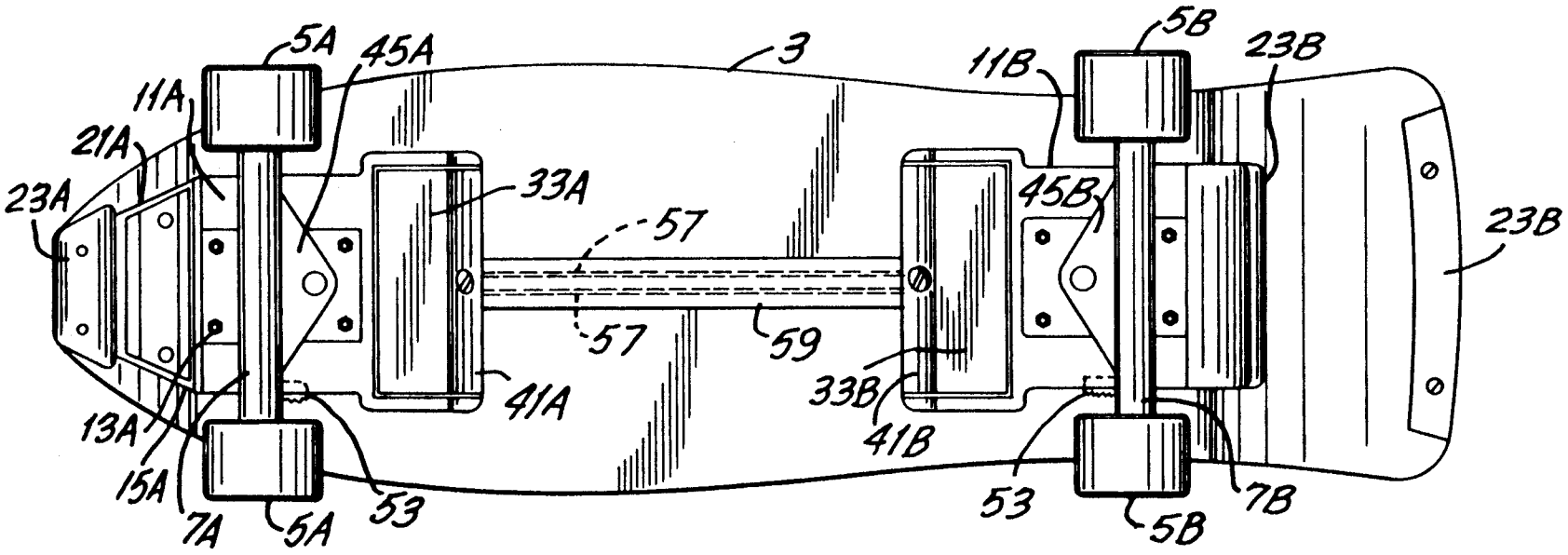
FIG. 4 is a bottom plan view of the skateboard.

Referring now to FIGS. 2 and 4, the front portion of the skateboard is shown equipped with a front lights assembly generally designated as 15 comprising a top flange extension 15A. The front lights assembly 15 comprises one or more light bulbs 17A mounted within a reflector 19A which is disposed within the front lights assembly cover 21A. A shock absorbing material is placed between the reflector and the assembly cover 21A to protect the light bulbs 17A.

The front edge of the platform 3 is protected against damage due to collision by the bumper guard 23A which can be gripped by the rider for manipulating the skateboard. The bumper guard may be designed to completely enshroud the lights assembly. The front lights assembly cover 21A is secured to the flange 15A of the front housing 11A by mean of the externally threaded screws 25A which engage the internally threaded holes 27A drilled through the rear portion of the flange 15A. Similarly, the bumper guard 23A is secured to the front edge of the flange 15A by means of the externally threaded screws 29A which engage the internally threaded holes 31A drilled in the front portion of the flange 15A.

As is further shown in FIG. 2, the front housing 11A includes a molded battery holder compartment 33A for receiving the battery holder/cover 35A. The battery holder/cover 35A is adapted to snap into engagement with the battery holder compartment receiver 33A, or it may be pressure fitted or attached thereto by any other suitable means. The battery holder/cover 35A includes recesses (not shown) for securely holding two pairs of batteries such as the batteries 37A, 37A which fit into the recess 39A, for securely holding the batteries in the battery holder compartment 33A when the battery holder/cover 35A is snapped into engagement within the compartment 33A. The batteries may be of conventional type such as the batteries used to energize household flashlights. A removable front battery door cover 41A fits on the underside of the compartment 33A and covers the lower exposed portion of the batter holder/cover 35A to protect the batteries and to provide access thereto. The cover 41A may be secured to the compartment 33A by means of the screws 43A as shown in FIG. 2.

Figure 5:
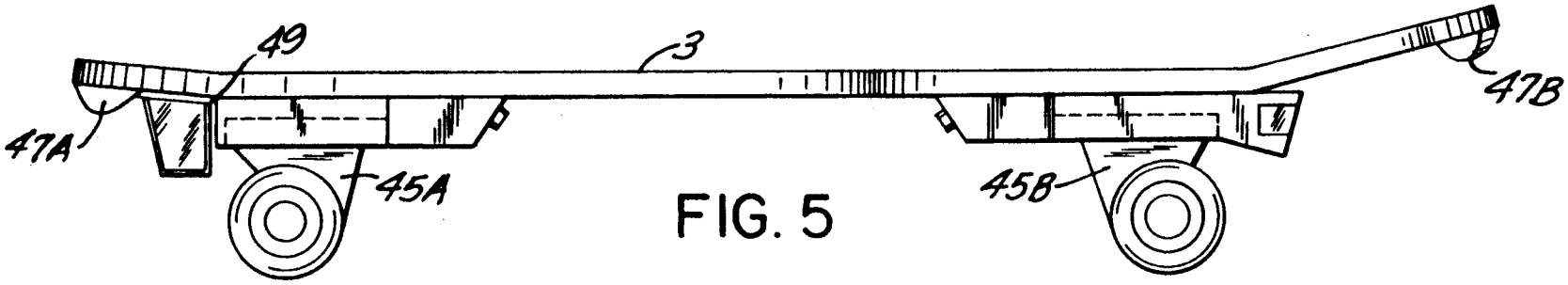
FIG. 5 is a side view of the skateboard.

In FIGS. 3-5, the rear portion of the skateboard 1 is shown comprising a rear housing 11B which is held between the platform 3 and the rear removable truck 45B by means of the rear mounting screws 9B which engage the rear mounting holes 13B as aforesaid. The rear housing 11B comprises the rear lights assembly 15B which comprises one or more illuminating bulbs 17B mounted in the reflector 19B which fits into the conforming recess 20 in the rear of the housing 11B. The rear edge of the housing 11B protects the recessed rear lenses of the skateboard from damage due to collision. The rear lens cover 23B which protects the light bulbs 17B is secured to the rear housing 11B by means of the externally threaded screws 25B which pass through aligned apertures in the lens cover 23B and the reflector 19B, and engage internally threaded holes (not shown) in the face surface of the recess 20.

At its rear portion, the rear housing 11B includes the molded battery holder compartment 33B which of similar general construction as the compartment 33A in the front assembly of the skateboard. The compartment 33B receives the battery holder/cover 35B by pressure fitting or snapping engagement of the battery holder/cover 35B into the compartment 33B. As in the front section the battery holder/cover 35B includes recessed portions for securely holding two pairs of batteries such as the batteries 37B, 37B which fit into the recess 39B, of the compartment 33B. As in the front batteries, the rear batteries may be of conventional type and variety such as the batteries used in household flashlights. A removable rear battery door cover 41B is attached to the compartment 33B (such as by the screws 43B) as shown in FIG. 3 and protects the batteries 37B, 37B as well as provides access thereto.

Referring to FIG. 5, a hand grip 47A made of a resilient material is securely mounted at the bottom front of the platform 3 and another hand grip 47B made of a similar material is attached to the bottom rear of said platform. A flexible joint 49 formed from a thinned section of the front housing 11A bridges the light assembly to the battery compartment and the platform 3 to allow the housing assembly to conform to the contour of the platform when a person rides thereon.

Figure 6A:
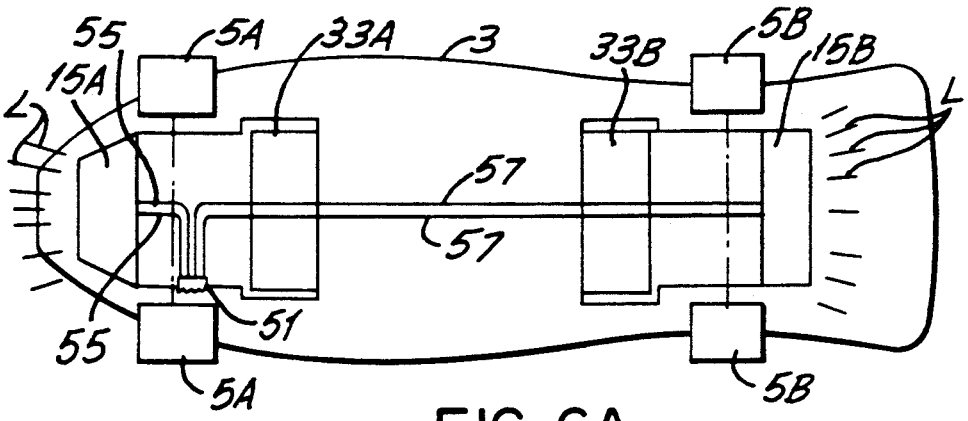
FIG. 6A is a simplified bottom view of the skateboard illustrating one type of switch means used to illuminate the front and rear of the skateboard of this invention.

Referring to FIGS. 2 and 4, and to FIG. 6A, there are shown a sliding switch 51 having a switch cover 53 located in the front housing 11A. As is further illustrated in FIG. 6A, a pair of conductive wires 55,55 establish electrical connection between the switch 51 and the front lights 17A which, when energized by the batteries 37A, 37A, issue light beams L thereby making the ground visible to the rider in the dark. A second pair of conductive wires 57,57 establish electrical contact between the switch 51 and the rear lights 17B which causes rearward light beams to issue from the rear of the skateboard and hence enhance its visibility from the rear and make it visible to others. The wires 55,55 and 57,57 are conveniently sheathed with the protected covers 59 (shown for the rear wire connections 57,57 in FIG. 4).

Figure 6B:
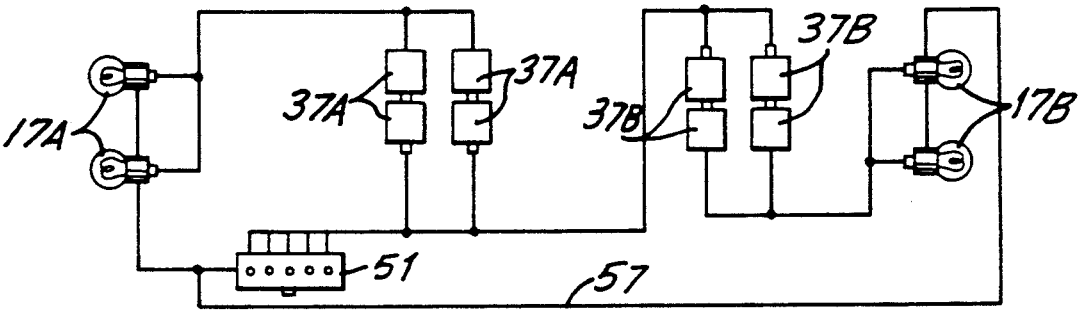
FIG. 6B is an electrical circuit diagram for the switch/lights assembly used in the embodiment illustrated by FIG. 6A.

Referring to FIG. 6B, the sliding switch 51 may be activated to illuminate the lights by simply sliding the switch to the "front" indicator, "front and rear" indicator, "rear" indicator or to the "flashing rear" indicator, as desired.

Figure 7A:
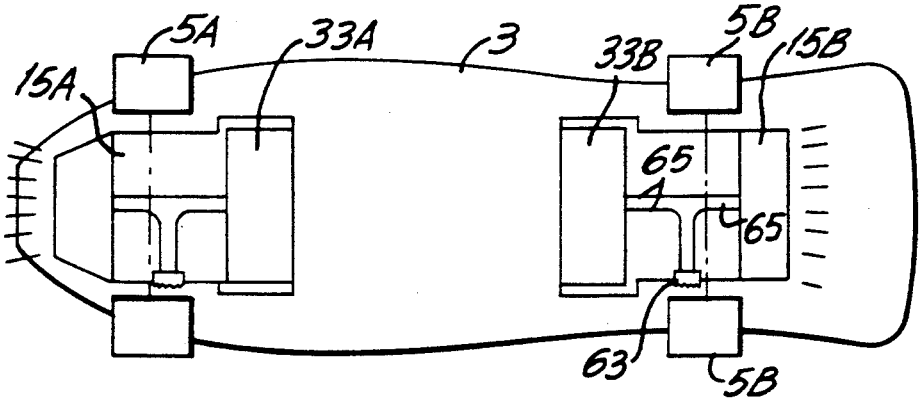
FIG. 7A is a simplified bottom view of the skateboard having separate front and rear switches for illuminating the front and rear portions of the skateboard, respectively.

FIG. 7A is similar to FIG. 6A except that two separate and independent switches with their corresponding separate electrical circuits are used to illuminate the front and rear lights, respectively. Thus, as shown in FIG. 7A, a sliding switch 59 is installed at the front bottom surface of the riding platform 3. The pair of wires 61, 61 establish electrical connection between the switch 59 and the front lights 17A in the front light housing assembly 11A and the batteries in the front battery compartment 33A when the switch is in the "on" position (see FIG. 7B). Thus, when the lights 17A are energized by turning the switch 59 to the "on" position, the front light beams illuminate the front of the skateboard.

A similar switch assembly is provided at the rear of the skateboard. Thus, the rear bottom surface of the riding platform 3 is equipped with a sliding switch 63 and a pair of wires 65,65 (which may be sheathed) establish electrical connection between the rear lights 17B in the rear light housing assembly 15B and the batteries located in the rear battery compartment 33B. Thus, by turning the switch 63 to the "on" position, the rear lights 17B illuminate the rear of the skateboard.

Figure 7B:
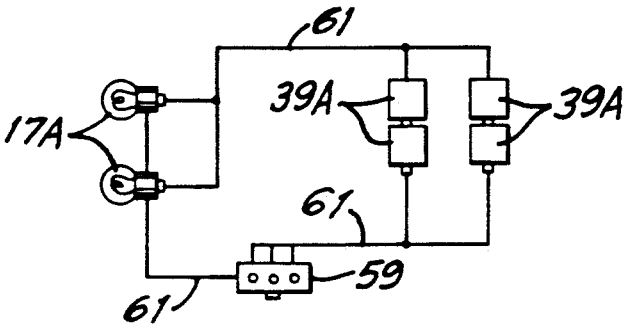
FIG. 7B is an electrical circuit diagram for each of the switch/lights assembly in FIG. 7A.

FIG. 7B is a schematic diagram of the electrical connection between the lights and the batteries for the front of the skateboard, (the rear diagram being identical except for reversing the positions of the lights and batteries.) The switch 59 may be activated to the "on" position to illuminate the front lights 17A, or it may be turned to the "flash" position in order to generate flashing signals, as desired. The rear lights 17B may be turned "on" or "flash" by turning the rear switch 63 as desired.

Figure 8A:
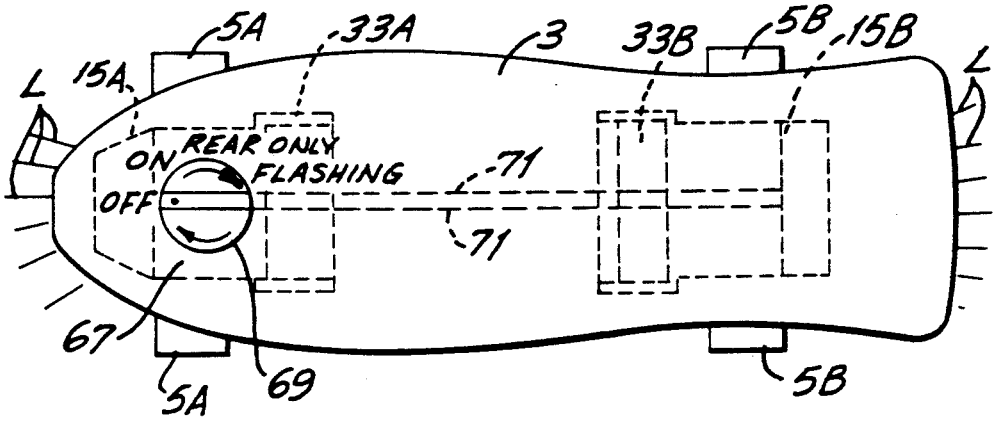
FIG. 8A is a simplified top view of the skateboard with a rotating switch for illuminating both the front and rear of the skateboard.

In the embodiment illustrated in FIG. 8A, the rotatable switch 67 having a rotatable knob 69 is mounted on the top surface of the riding platform 3. The pair of wires 71,71 establish electrical connection between the front lights 17A and front batteries 39A and also between the rear lights 17B and rear batteries 39B. As in FIGS. 6A and 7A, the wires 71,71 may be sheathed to protect the wires from mechanical damage.

Figure 8B:
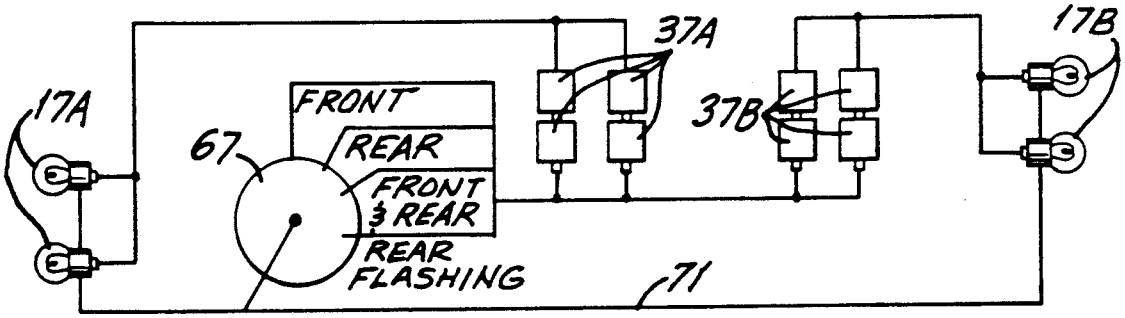
FIG. 8B is an electrical circuit diagram for the switch/light assembly shown in FIG. 8.

Referring to FIG. 8B, the rotatable knob 69 may be turned to any of the indicated positions, i.e., "front", "rear", "front and rear" or "rear flash" to illuminate the appropriate light bulbs 17A, 17A or 17B, 17B or both.

The circuitries illustrated in FIG. 6A, 7A, 7B and 8A are themselves generally known to those skilled in the art and do not require detailed explanation or description.

Figure 9:
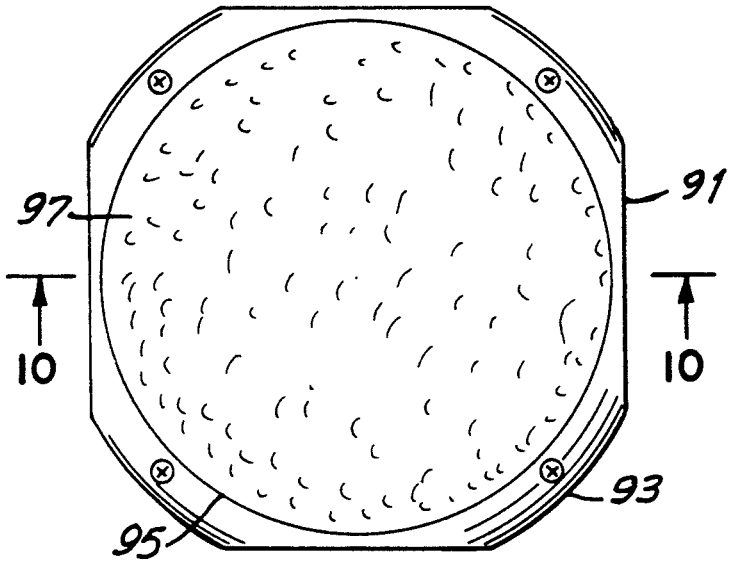
FIG. 9 is a top view of the disk assembly for use to rotatably maneuver the skateboard.
Figure 13:
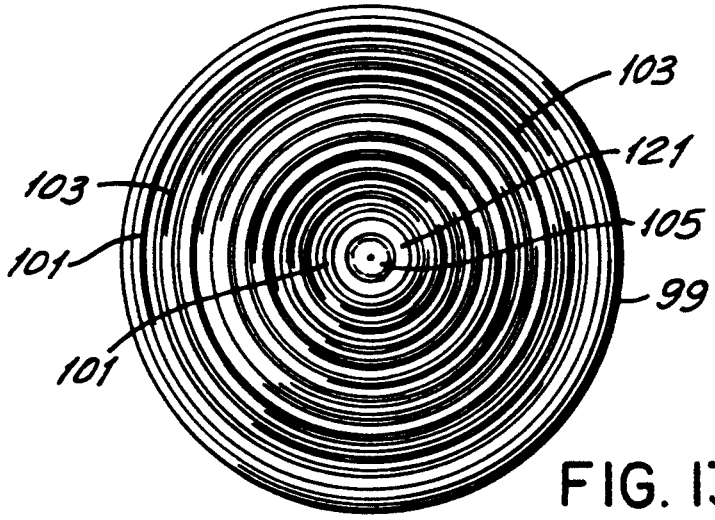
FIG. 13 is a bottom view of the rotatable disk assembly shown in FIG. 9.

Referring to FIG. 9, there is shown the top view of the disk assembly generally designated by reference numeral 91 comprising the mounting plate 93 and the spinning disk 95. The disk 95 may be fabricated from a relatively hard plastic such as polyurethane or high impact polystyrene and has a textured top surface 97 in order to prevent slippage of the rider's foot. The lower surface 99 of the disk 93 is formed with a series of concentric circular, spaced-apart grooves 101 separated by the concentric ridges 103 formed about a relatively flat central recessed portion 105, as shown in FIG. 13.

Figure 11:
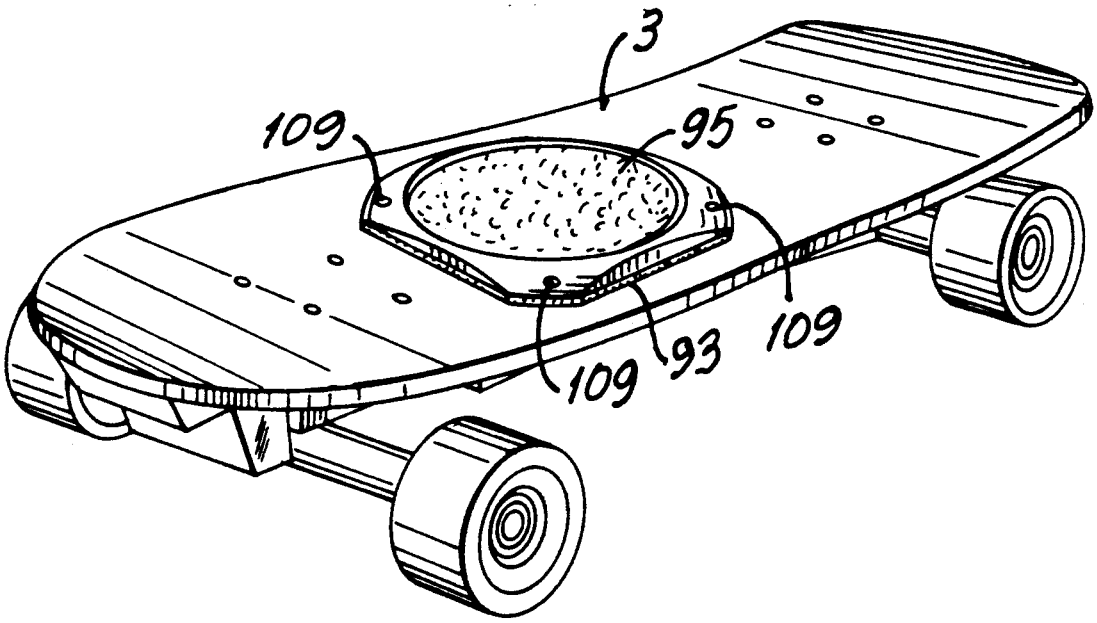
FIG. 11 is a top plan view of a skateboard shown in FIG. 1 with the disk assembly mounted on the upper surface of the riding platform.
Figure 12:
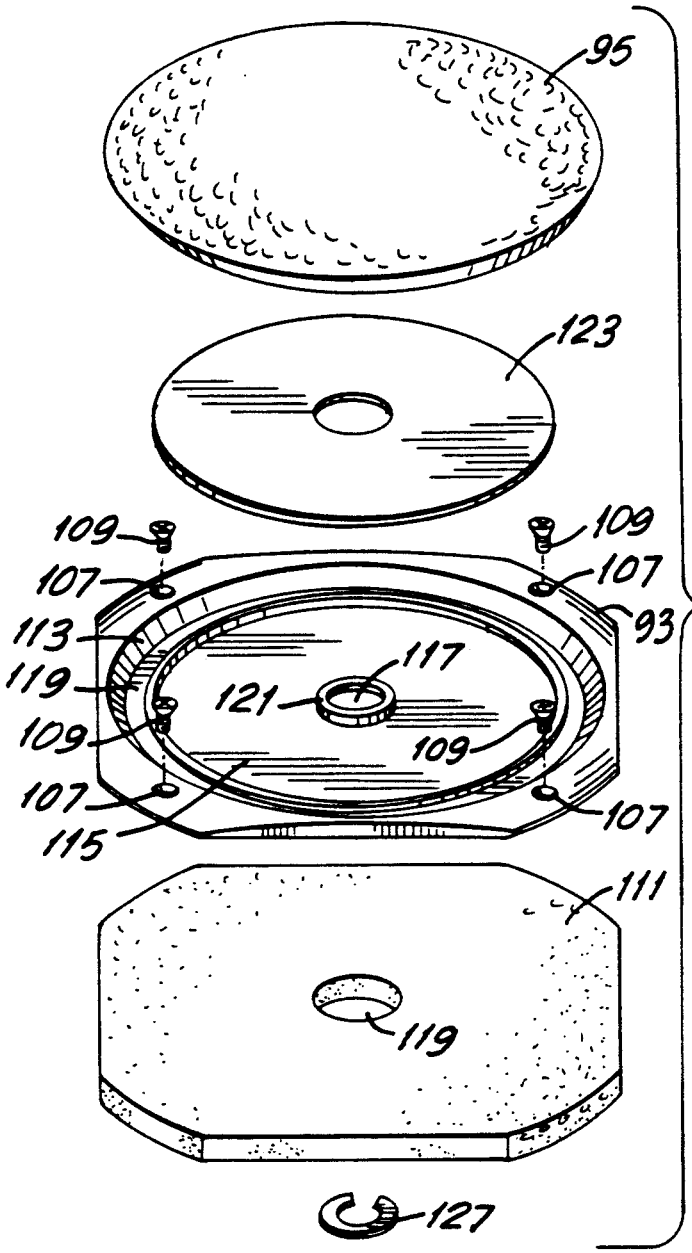
FIG. 12 is an exploded view of the disk assembly shown in FIG. 9.

In FIG. 12, there is shown the mounting plate 93 having four apertures 107 and the mounting screws 109 for securing the disk assembly to the top surface of the riding platform 3 of the skateboard (see FIG. 11). The mounting plate 93 is secured, e.g., bonded, to the contour adjusting pad 111 which may be fabricated from a suitable resilient or foamed plastic such as polyurethane.

The mounting plate 93 may be generally circular or rectangular in configuration, or it may have the configuration shown in FIG. 9. This plate may be fabricated from a hard durable plastic such as polyurethane or high impact polystyrene, with peripheral inwardly recessed edge or lip 113 and has a generally circular, relatively hard, flat mounting plate surface 115 having a central aperture 117. The mounting plate surface 115 has an outer circumferential ridge 119 adapted to engage an outermost circumferential groove 101 in the lower surface 99 of the spinning disk 95. An inner circumferential ridge 121 is formed about the central aperture 117 for engaging an innermost circumferential groove 101. The circumferential grooves 101 have approximately the same width and are dimensioned so that the outermost and innermost grooves 101 engage the corresponding circumferential ridges 119 and 121, respectively on the mounting plate surface 115. The spinning disk 95 is sized to fit snugly inside the mounting plate 93, abutting the mounting plate's peripheral recessed edge or lip 113, with the ridges 119 and 121 nesting into the respective grooves 101 as aforesaid. In this manner, the lower surface 99 of the disk 95 will be spaced apart a finite distance (usually from about $\frac{1}{8}$ to $\frac{3}{8}$ inch) relative to the mounting plate surface 115. This surface is usually smooth, or it may be lightly lubricated to provide a frictionless surface in order to facilitate spinning of the disk 95 when it is pressed and maneuvered by a foot of the rider on the riding platform.

Figure 10:
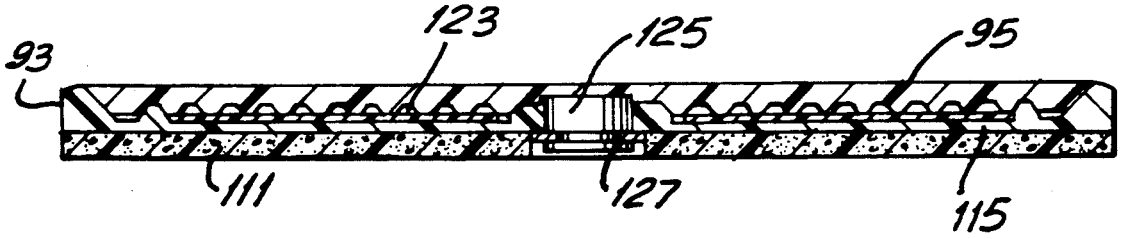
FIG. 10 is a sectional view taken along the line 9—9 of FIG. 9.

Optionally, a Teflon plate 123 may be conformally mounted on the mounting plate surface 115 to further facilitate and promote spinning of the disk 95 (see FIGS. 10 and 12).

In order to secure the components of the disk assembly 91 together, a resilient retainer member 125 in the form of a small button-like disk is friction fitted or snugly inserted through the aperture 119 and is secured by the horse-shoe shaped retainer ring or clip 127 as is also shown in FIGS. 10 and 12. The retainer 125 protrudes above the ridge 121 and fits snugly into and against the recess 105 in the lower surface 99 of the disk 95. Thus, the retainer 125 serves as a central axis about which the disk 95 spins as force is applied against the disk when it is manipulated into different degrees of rotation.

Since the disk assembly is securely mounted on the top surface of the riding platform 3, the skateboard may be readily maneuvered into different directions by riding on said platform with one or both feet of the rider and pressing against the top surface 97 of the disk 95, and manipulating the disk 95 into different directions and degrees of rotation.

It is obvious from the foregoing detailed description that several changes and modifications may be made in the present invention. For example, rather than mounting the disk assembly on the top surface of the riding platform 3, the disk assembly may be placed within a conforming recessed cavity so that the top surface 97 of the disk 95 will be flush with the top surface of the riding platform 3. This and other changes are nevertheless within the scope of the present invention.

What is claimed is:

1. A skateboard with rotatably mounted disk for rotatably maneuvering the skateboard, comprising, in combination:

(a) a riding platform having a top riding surface and a bottom surface;

(b) wheels depending from said bottom surface and rotatable about their respective axles;

(c) a rotatable disk secured to the top surface of said riding platform so as to rotatably maneuver the skateboard in different directions when said disk is manipulated by a foot of the skateboard rider, said rotatable disk comprising a disk member having a top textured surface and a bottom surface; a mounting plate secured to the top surface of said riding platform, said mounting plate having a recessed, relatively smooth surface for receiving said disk and facilitating rotation of said disk member by pressing said disk member against said surface of the mounting plate, and a contour pad secured between the top surface of the platform and bottom surface of the plate, said contour pad including a central aperture aligned with the central aperture in said mounting plate, a retainer member inserted through said apertures for uniting said mounting plate and said contour pad, and a retainer clip for securing said mounting plate to said contour pad.

2. A skateboard as in claim 1 further including front and rear illumination sources comprising:

(d) a front truck member;

(e) a front housing secured between said platform and said front truck member;

(f) a rear truck member;

(g) a rear housing secured between said platform and said rear truck member;

(h) a front illumination assembly in said front housing, said front illumination assembly comprising a reflector member within which is mounted a front illumination source; and (i) a rear illumination assembly in said rear housing, said rear illumination assembly comprising a reflector member within which is mounted a rear illumination source.

3. An illuminated skateboard as in claim 2 wherein said front housing comprises at least one illumination source and at least one power source, said rear housing comprising at least one illumination source and at least one power source, means for establishing electrical communications between each of said illumination sources and its respective power source, and switch means operable to activate said means for establishing said electrical communication.

4. An illuminated skateboard as in claim 3 wherein said illumination source in the rear housing is a flashing light source.

5. An illuminated skateboard as in claim 3 wherein said power sources are batteries.

6. An illuminated skateboard as in claim 3 wherein said means for establishing electrical communication between each of said illumination sources and each of said power sources is an electrically conductive wire.

7. An illuminated skateboard as in claim 4 wherein said means for establishing electrical communication between each of said illumination sources and each of said power sources is an electrically conductive wire.

8. An illuminated skateboard as in claim 5 wherein said means for establishing electrical communication between each of said illumination sources and each of said power sources is an electrically conductive wire.

9. An illuminated skateboard as in claim 3 wherein said switch means is a rotatable switch secured to the top surface of said riding platform.

10. A skateboard as in claim 2 further including a rotatable disk secured to the top surface of said riding platform so as to rotatably maneuver the skateboard in different directions when said disk is manipulated by a foot of the skateboard rider.

11. A rotatable disk assembly comprising a disk member having a top surface and a bottom surface, said bottom surface having a series of at least three concentric, spaced-apart grooves separated by a series of at least three concentric ridges; a mounting plate having a recessed relatively smooth top surface for receiving said disk and a central aperture in said surface; a generally circular inner ridge formed about said aperture on said surface of the mounting plate, a generally outer circular ridge on said surface of the mounting plate spaced away from said inner ridge, said inner ridge and outer ridge being dimensioned to engage an inner groove and an outer groove in the bottom surface of said disk to permit rotation of said disk within said mounting plate when said disk is rotatably forced against said top surface of the mounting plate, and a contour pad positioned between the bottom surface of the plate and the top surface of the skateboard, said contour pad including a central aperture aligned with the central aperture in said mounting plate, a retainer member inserted through said apertures for uniting said mounting plate and said contour pad, and a retainer clip for securing said mounting plate to said contour pad.

* * * * *